US005819772A

United States Patent [19]

Pi

[11] Patent Number: 5,819,772

[45] Date of Patent: Oct. 13, 1998

[54] WALKER FOR DISABLED PERSONS

[76] Inventor: Ching-Tien Pi, 3F, No. 36, Lane 105, Sec. 1, Pe Yi Rd., Shin Tien City, Taipei Hsien, Taiwan

[21] Appl. No.: 675,475

[22] Filed: Jul. 15, 1996

[51] Int. Cl.[6] ..... A45B 3/00

[52] U.S. Cl. ..... 135/66; 135/67; 135/74

[58] Field of Search ..... 135/66, 67, 74, 135/77, 65, 75; 297/5–7; 482/66, 69, 68

[56] References Cited

U.S. PATENT DOCUMENTS

| | | | |
|---|---|---|---|
| 3,658,079 | 4/1972 | Block | 135/67 |
| 3,690,652 | 9/1972 | Schneider | 135/67 X |
| 3,945,389 | 3/1976 | Smith | 135/67 |
| 4,162,101 | 7/1979 | McCague, Sr. et al. | 135/67 X |
| 4,251,105 | 2/1981 | Barker | 135/67 X |
| 4,643,211 | 2/1987 | Morris et al. | 135/67 |
| 4,800,910 | 1/1989 | Gamm | 135/67 |
| 4,907,839 | 3/1990 | Rose et al. | 135/67 X |
| 5,133,377 | 7/1992 | Truxillo | 135/67 |
| 5,353,824 | 10/1994 | Woods et al. | 135/66 |
| 5,524,657 | 6/1996 | Jih | 135/66 |

*Primary Examiner*—Lanna Mai

[57] ABSTRACT

A walker which includes a rectangular open back frame, two handrails respectively connected to the two opposite ends of the back frame at right angles and disposed in parallel to each other, each handrail having a sliding track disposed in a sloping position, two front wheel assemblies and two rear wheel assemblies respectively coupled to the handrails at the bottom, a seat frame, and two suspension links respectively and slidably coupled to the sliding tracks to hold the seat frame between the handrails.

7 Claims, 8 Drawing Sheets

WALKER FOR DISABLED PERSONS

BACKGROUND OF THE INVENTION

The present invention relates to walkers for disabled persons, and relates more particularly to such a walker which has a seat frame that slides forwards along two parallel sliding tracks when the user sits thereon.

An aged or disabled person may have to use a walker for walking. FIG. 1 shows a regular walker for this purpose. As illustrated, the walker is comprised of two parallel handrails, and a connecting frame connected between the parallel handrails. However, this structure of walker is not practical in use because it is not an easy job to a disabled person to lift the walker from the ground and then to move it ahead. The user will feel quite exhausted within a short period of time after using the walker for walking. Because the walker has no seat means for sitting, the user can only maintain oneself in the standing position when resting. Some disabled persons may use a wheeled chair for walking. However, propelling a wheeled chair consumes much effort. Furthermore, using a wheeled chair cannot exercise the legs.

SUMMARY OF THE INVENTION

The present invention has been accomplished under the circumstances in view. It is one object of the present invention to provide a walker which helps the user walk with less effort. It is another object of the present invention to provide a walker which has seat means for sitting. It is still another object of the present invention to provide a walker which is collapsible. According to one aspect of the present invention, the walker comprises a rectangular open back frame, two handrails respectively connected to the two opposite ends of the back frame and disposed in parallel to each other, each handrail having a sliding track disposed in a sloping position, two front wheel assemblies and two rear wheel assemblies respectively coupled to the handrails at the bottom, a seat frame, and two suspension links respectively and slidably coupled to the sliding tracks to hold the seat frame between the handrails. According to another aspect of the present invention, the sliding track of each handrail has a rear end pivoted to the vertical rear tube of the respective handrail and a front end terminating in a spring-supported extension rod adjustably fitted into one of a longitudinal series of pin holes on the vertical front tube of the respective handrail. Therefore the sloping angle of the sliding track can be adjusted as desired. According to another aspect of the present invention, the handrails are pivotably connected to two opposite ends of the back frame, having a respective sector frame fixed to the back frame by a respective lock screw. By loosening each lock screw, the handrails can be turned inwards and closely attached to the back frame. According to still another aspect of the present invention, each front wheel assembly is comprised of a foot rod coupled to one handrail, a front wheel holder frame coupled to the foot rod in parallel by a slip joint, a front wheel coupled to the bottom end of the front wheel holder frame, and a compression spring coupled between the front wheel holder frame and the front wheel. When the handrails are pressed down with effort, the foot rods of the front wheel assemblies are lowered to touch the ground and to stop the walker from moving on the ground. When the downward pressure is released from the handrail, the foot rods are moved upwards relative to the front wheel holder frames, and therefore the walker can be moved on the ground through the front wheels and the rear wheels of the rear wheel assemblies.

DETAILED DESCRIPTION OF THE PREFERRED EMBODIMENT

Figure 1:
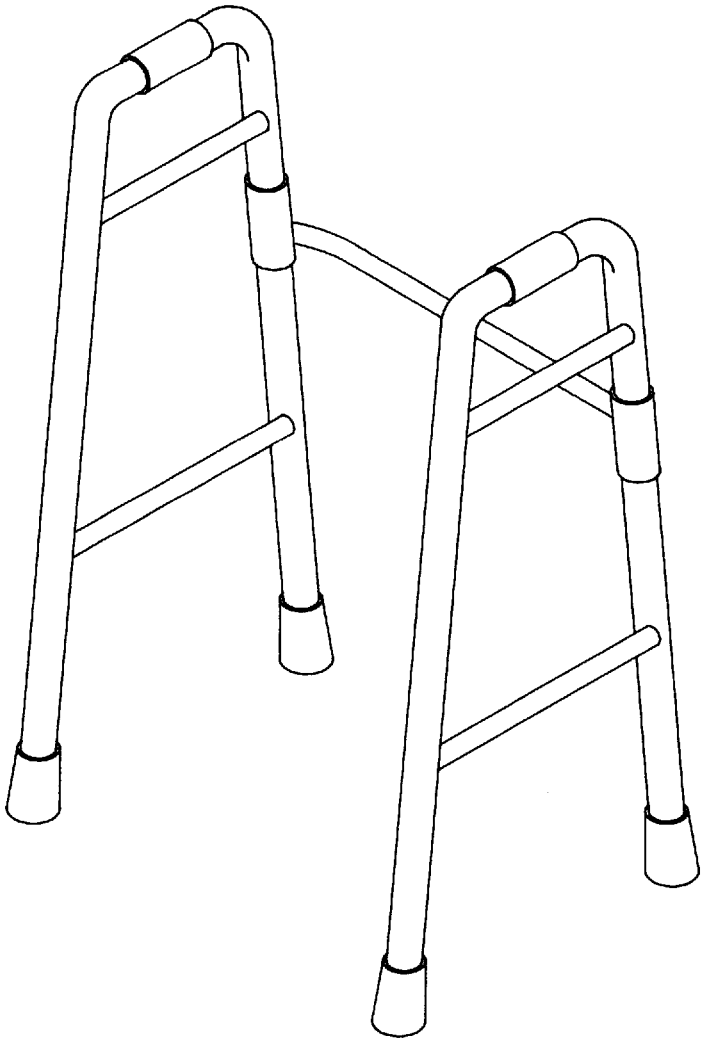
FIG. 1 (PRIOR ART)
FIG. 1 is an elevational view of a walker according to the prior art.
Figure 2:
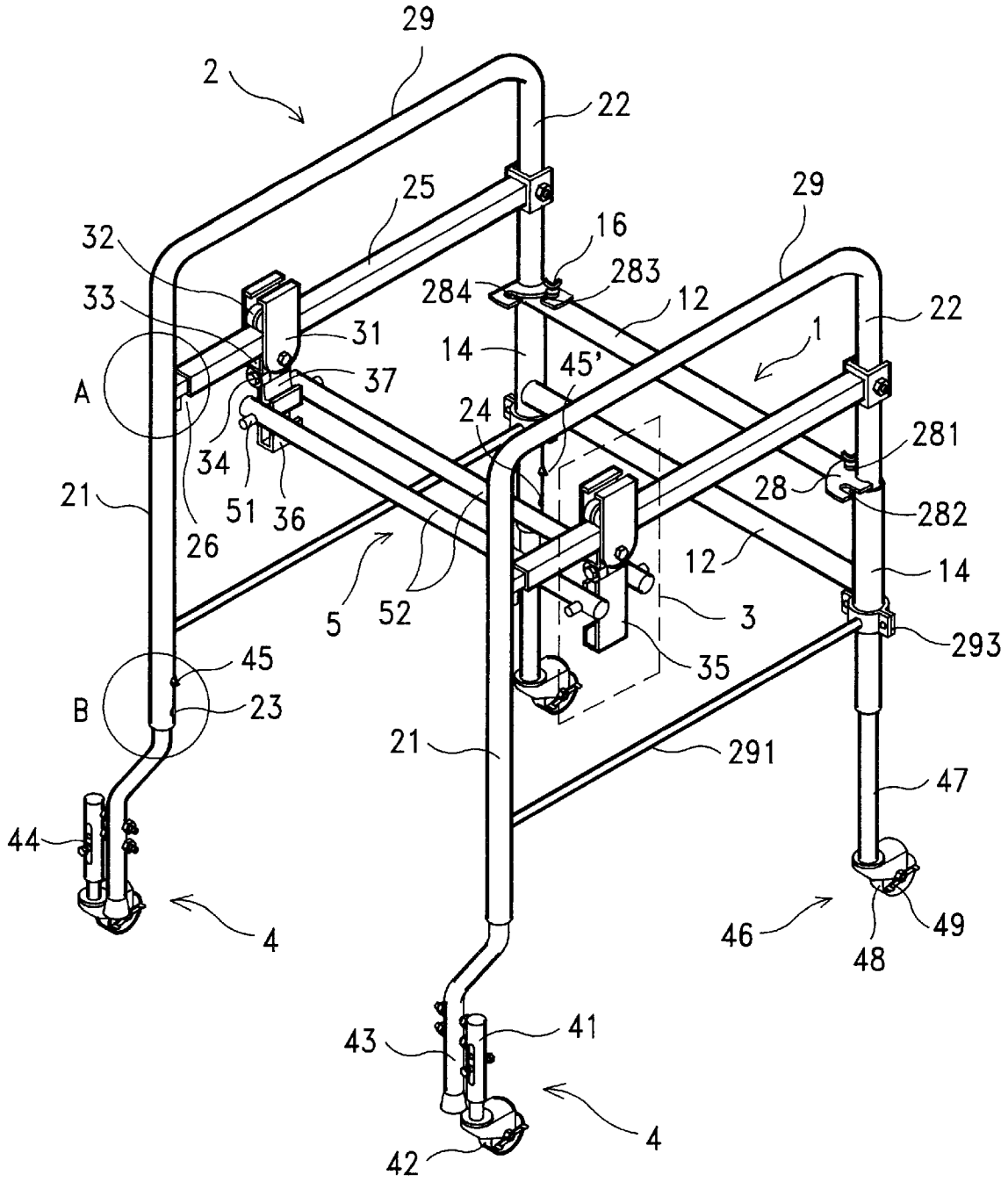
FIG. 2 is an elevational view of a walker according to the present invention.

Referring to FIG. 2, a walker in accordance with the present invention is generally comprised of a back frame 1, two handrails 2, two suspension links 3, two front wheel assemblies 4, two rear wheel assemblies 46, and a seat frame 5.

The back frame 1 is a rectangular open frame comprised of two vertical tubes 14, and two horizontal tubes 12 connected between the vertical tubes 14 at different elevations. The horizontal tube 12 which is disposed at the top side is mounted with two lock screws 16, which are respectively disposed adjacent to the vertical tubes 14. Each of the handrails 2 comprises a vertical front tube 21, a vertical rear tube 22, and a horizontal top tube 29 connected between the vertical front tube 21 and the vertical rear tube 22 at the top. The handrails 2 are bilaterally coupled to the back frame 1 by inserting the vertical rear tubes 22 through the vertical tubes 14 respectively. The vertical front tube 21 has a first series of pin holes 23 longitudinally disposed adjacent to the bottom end, and a second series of pin holes 27 (see FIG. 2A) longitudinally disposed near the horizontal top tube 29. The vertical rear tube 22 has a series of pin holes 24 longitudinally disposed near the bottom end. A sliding track 25 is mounted between the vertical front tube 21 and the vertical rear tube 22, having one end pivoted to the vertical rear tube 22 of the respective handrail 2, and an opposite end terminating in a spring-supported extension rod 26 fitted into one of the second series of pin holes 27 of the vertical front tube 21 of the respective handrail 2 (see FIG. 2A). By moving the spring-supported extension rod 26 from one of the second series of pin holes 27 to another, the sliding track 25 is adjusted to the desired angular (sloping) position. A cross rod 291 is connected between the vertical front tube 21 and vertical rear tube 22 of each handrail 2, having one end mounted with a clamp 293 fixed to the vertical rear tube 22 of the respective handrail 2. The vertical rear tube 22 of each handrail 2 is fixedly mounted with a sector frame 28, which is stopped above the back frame 1 and, has a plurality of retaining notches 281,282;283,284 adapted for coupling to the lock screws 16 at one end of the top horizontal tube 12 of the back frame 1.

Figure 5:
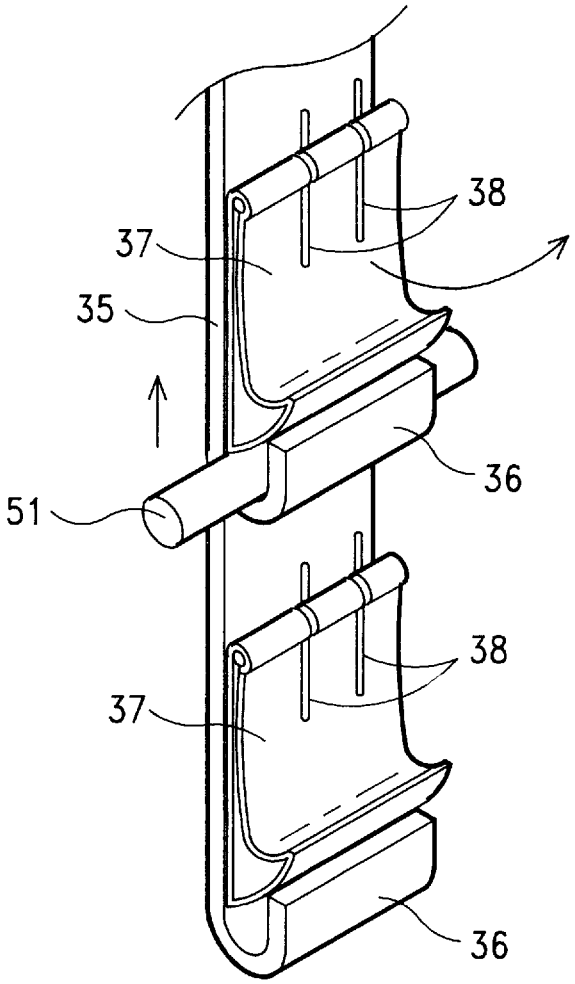
FIG. 5 is an elevational view in an enlarged scale of the suspension frame of the suspension link according to the present invention.

Referring to FIGS. 2 and 5, the seat frame 5 is slidably coupled to the sliding tracks 25 by the suspension links 3.

Each of the suspension sliding links 3 is comprised of a suspension frame 35, a pulley block 31, and a connector 34 connected between the suspension frame 35 and the pulley block 31. The pulley block 31 comprises a pulley wheel assembly 32 at the top, and a sliding block 33 at the bottom. The pulley wheel assembly 32 and the sliding block 33 are respectively and movably mounted on the top and bottom sides of the sliding track 25 of one handrail 2. The suspension frame 35 is connected to the bottom side of the pulley block 31 by the connector 34, comprising a plurality of hanging hooks 36 disposed at different elevations, and a plurality of springy retainer plates 37 respectively disposed above the hanging hooks 36 (see FIG. 5). The seat frame 5 is comprised of two seat frame rods 52 horizontally disposed in parallel, and two connecting rods 51 connected between the seat frame rods 52 at two opposite ends. The connecting rods 51 of the seat frame 5 are respectively hung on one hanging hook 36 of each suspension frame 35 and held down by the corresponding retainer plate 37. Therefore, the elevation of the seat frame 5 can be adjusted by changing the connection between the connecting rods 51 of the seat frame 5 and the hanging hooks 36 of the suspension frames 35 of the suspension links 3.

Figure 2A:
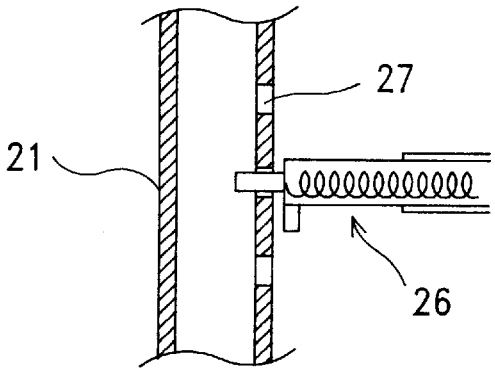
FIG. 2A is an enlarged view in section of part A of FIG. 2.
Figure 2B:
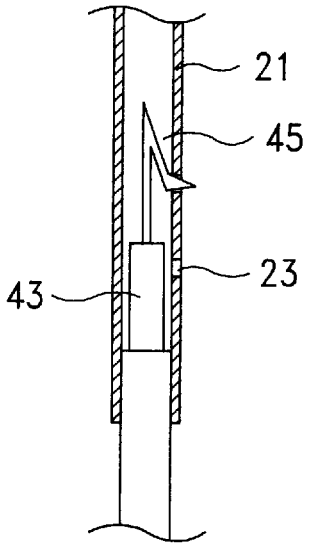
FIG. 2B is an enlarged view in section of part B of FIG. 2.
Figure 3:
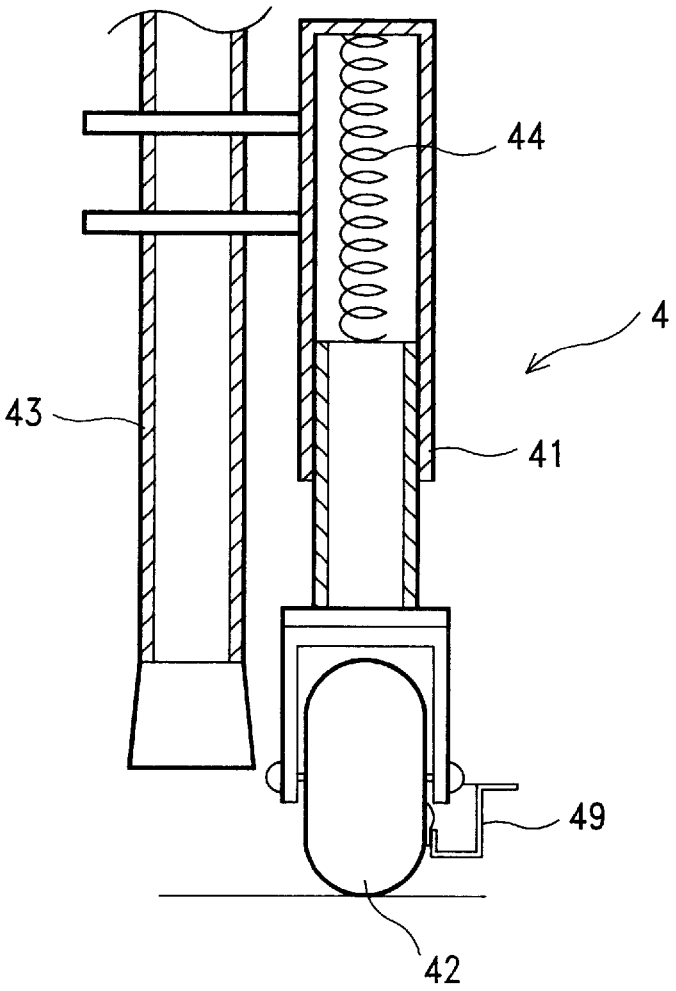
FIG. 3 is a front view in section of the front wheel assembly according to the present invention when disposed in the moving position.

Referring to FIGS. 2, 2B, and 3, the front tubes 21 and rear tubes 22 of the handrails 2 are respectively connected to the front wheel assemblies 4 and the rear wheel assemblies 46. Each of the front wheel assemblies 4 is comprised of a front wheel holder frame 41, a spring hook 45, a directional front wheel 42, and a foot rod 43. The spring hook 45 is fixed to the top end of the foot rod 43, and inserted into the bottom end of the front tube 21 of one handrail 2 into engagement with one of the first series of pin holes 23 (see FIG. 2B). The front wheel holder frame 41 is slidably coupled to the foot rod 43 to hold the front wheel 42 through a compression spring 44. When the user presses down the top tubes 29 of the handrails 2, the compression spring 44 of each front wheel assembly 4 is compressed, and the front wheel holder frame 41 is moved vertically relative to the foot rod 43, thereby causing the foot rod 43 to stop against the ground, and therefore the walker is stopped from moving on the ground. Each of the rear wheel assemblies 46 is comprised of a rear wheel holder frame 47, a spring hook 45', and a swivel wheel 48. The spring hook 45' is fixed to the top end of the rear wheel holder frame 47, and inserted into the bottom end of the rear tube 22 of one handrail 2 into engagement with one of the first series of pin holes 24 of the rear tube 22 (the structure and function of the spring hook 45' are similar to that of the spring hook 45 of each front wheel assembly 4). Furthermore, the directional wheel 42 of each front wheel assembly 4 and the swivel wheel 48 of each rear wheel assembly 46 is respectively equipped with a conventional wheel brake 49 for braking.

Figure 4:
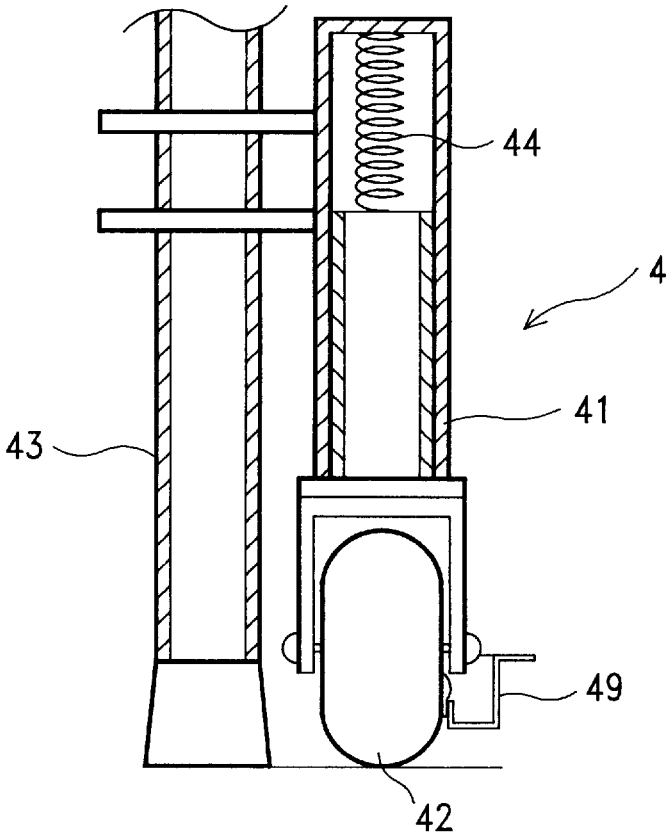
FIG. 4 is similar to FIG. 3 but showing the front wheel assembly disposed in the stopped position.

Referring to FIGS. 3 and 4, as illustrated, the front wheel assembly 4 is comprised of a front wheel holder frame 41, a foot rod 43, a directional front wheel 42, and a compression spring 44. When the walker is moving, the directional wheel 42 is directly disposed in contact with the ground, the foot rod 43 suspends above the ground without stopping the directional front wheel 42 from moving (see FIG. 3). When the top tube 29 of one handrail 2 is pressed down, the respective foot rod 43 is lowered to touch the ground and simultaneously to compress the compression spring 44 (see FIG. 4).

Referring to FIG. 5, the suspension frame 35 of each suspension link 3 comprises a plurality of hanging hooks 36 disposed at different elevations, and a plurality of springy retainer plates 37 respectively disposed above the hanging hooks 36. The springy retainer plates 37 are respectively pivoted to the hanging hooks 36 and retained in the respective holding-down position by respective torsional springs 38. By pulling the springy retainer plate 37 upwards to overcome the spring force of the respective torsional springs 38, the corresponding connecting rod 51 of the seat frame 5 can than be coupled to or removed from the corresponding hanging hook 36. Because the curvature of the springy retainer plates 37 fits the profile of the hanging hooks 36 and the springy retainer plates 37 are respectively held down on the hanging hooks 36 by the respective torsional springs 38, the connecting rods 51 of the seat frame 5 are prohibited from escaping out of position after installation.

Figure 6:
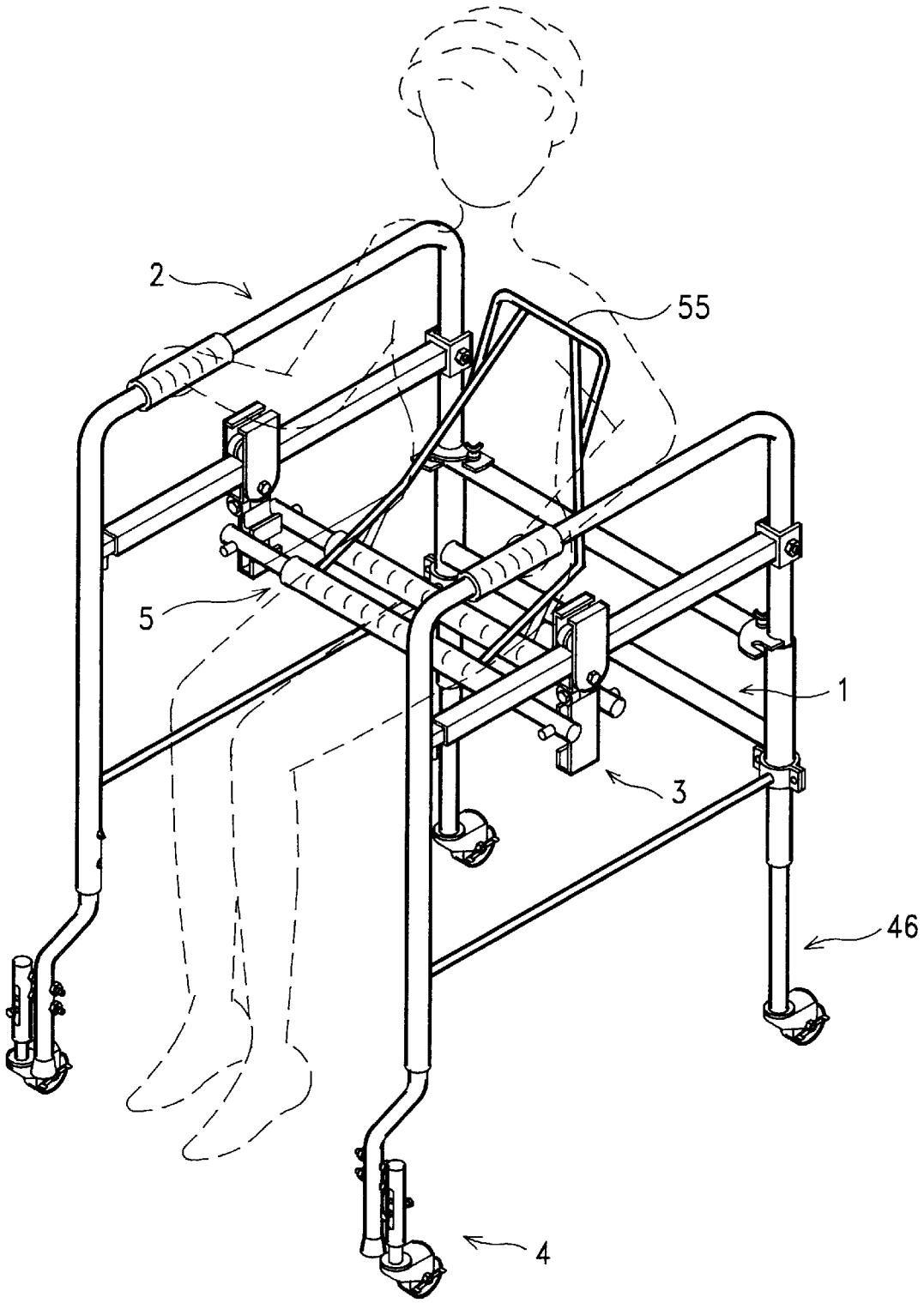
FIG. 6 is an applied view of the present invention, showing the user carried on the seat frame.

Referring to FIGS. 2, 2A and 6, when in use, the elevation of the handrails 2 is adjusted by adjusting the connection between the spring hooks 45,45' and the pin holes 23,24, then the sloping position of the sliding tracks 25 is adjusted by adjusting the connection between the spring-supported extension rods 26 of the sliding tracks 25 and the pin holes 27 of the vertical front tubes 21 of the handrails 2. When the user sits on the seat frame 5, the seat frame 5 and the user are moved forwards from the back side (the rear tubes 22) to the front side (the front tubes 21) by means of the sliding of the suspension links 3 along the sliding tracks 25 (because the sliding tracks 25 are respectively retained in a sloping position). After reaching the front side, the user can then stands up and push the walker forwards. Because the seat frame 5 is stopped by the user's backside, the seat frame 5 is moved along the sliding tracks 25 from the front tubes 21 to the rear tubes 22 when the walker is pushed forwards by the user. Therefore, the user can then sit on the seat frame 5 again and then be carried by the seat frame 5 from the back side to the front side. By repeating the aforesaid procedure, the user walks with the walker smoothly. Furthermore, a seat 55 may be mounted on the seat frame 5 for the sitting of the user comfortably. The pitch between the seat frame rods 52 may be adjusted by adjusting the connecting points between the seat frame rods 52 and the connecting rods 51; the top tubes 29 of the handrails 2 and the seat frame rods 52 may be respectively covered with soft covering means. The seat frame 5 may be detached from the walker, and the user can directly use the walker without seat frame.

Figure 7:
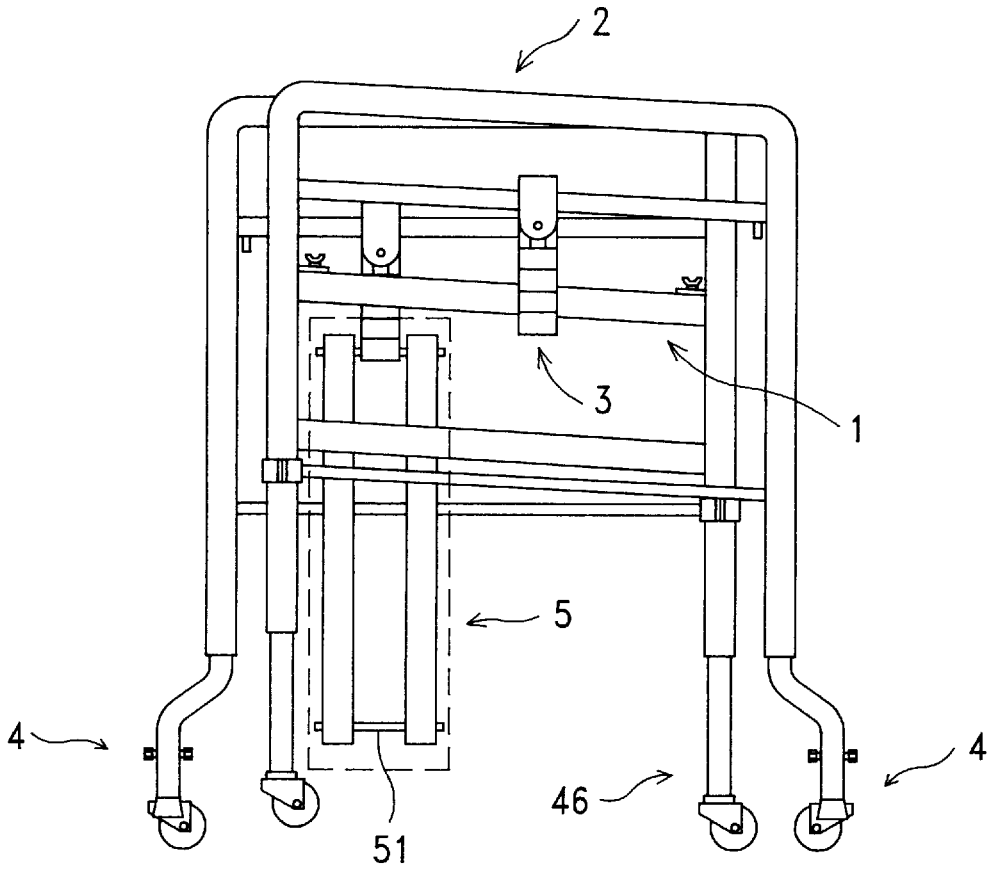
FIG. 7 is a front view of the present invention, showing the walker collapsed.

Referring to FIGS. 7 and 2 again, when not in use, the walker can be collapsed. When one connecting rod 51 of the seat frame 5 is disconnected from the corresponding suspension link 3, the lock screws 16 are respectively loosened from the retaining notches 281,282;283,284, and then the handrails 2 are turned backward and then inward to become closely attached to each other at the back side of the back frame 1. When collapsed, the lock screws 16 are fastened up again to fix the walker in the collapsed position.

While only one embodiment of the present invention has been shown and described, it will be understood that various modifications and changes could be made without departing from the spirit and scope of the invention disclosed.

What the invention claimed is:

1. A walker comprising:

a back frame, said back frame two vertical tubes and two horizontal tubes connected between the vertical tubes at different elevations;

two handrails respectively connected to said back frames at right angles and disposed in parallel to each other, each of said handrails comprising a vertical front tube having a top end and a bottom end, a vertical rear tube coupled to one vertical tube of said back frame and having a top end and a bottom end, a horizontal top tube connected between the top ends of said vertical front tube and said vertical rear tube, said vertical front tube having a first series of pin holes longitudinally spaced from the bottom end and a second series of pin holes longitudinally spaced from the top end, said vertical rear tube having a series of pin holes longitudinally spaced from the bottom end, a sliding track mounted between said vertical front tube and said vertical rear tube, said sliding track having one end pivoted to said vertical rear tube, and an opposite end terminating in a spring-supported extension rod fitted into one of the second series of pin holes of said vertical front tube, and a cross rod connected between said vertical front tube and said vertical rear tube, said cross rod having one end mounted with a clamp fixed to said vertical rear tube and an opposite end connected to said vertical front tube;

two suspension links respectively coupled to said sliding tracks, each of said suspension links comprising a suspension frame, a pulley block, and a connector connected between said suspension frame and said pulley block, said pulley block comprising a pulley wheel assembly and a sliding block respectively and movably mounted on the sliding track of the respective handrail at two vertically spaced opposite sides, said suspension frame being connected to said pulley block at a bottom side and comprising a plurality of hanging hooks disposed at different elevations and a plurality of springy retainer plates respectively mounted on said hanging hooks;

a seat frame connected between the suspension frames of said suspension links, said seat frame comprising two seat frame rods horizontally disposed in parallel, and two connecting rods connected between said seat frame rods at two opposite ends, each of said connecting rods being coupled to one hanging hook of one suspension link and held down by the corresponding retainer plate;

two front wheel assemblies respectively connected to the bottom ends of the vertical front tubes of said handrails, each of said front wheel assemblies comprising a foot rod slidably inserted into the bottom end of the vertical front tube of one handrail, a spring hook fixedly secured to said foot rod and forced into engagement with one of the first series of pin holes of the corresponding vertical front tube, a front wheel holder frame connected to said foot rod in parallel by a slip joint, a directional front wheel coupled to said front wheel holder frame by a compression spring, said directional front wheel being disposed at a lower elevation than said foot rod, said foot rod being lowered into touch with the ground when the corresponding handrail is depressed; and two rear wheel assemblies respectively connected to the bottom ends of the vertical rear tubes of said handrails, each of said rear wheel assemblies comprising a rear wheel holder frame slidably inserted into the bottom end of the vertical rear tube of one handrail, a spring hook fixedly secured to said rear wheel holder frame and forced into engagement with one of the pin holes of the vertical rear tube of the corresponding handrail, and a swivel wheel coupled to said rear wheel holder frame.

2. The walker of claim 1 wherein the vertical rear tube of each of said handrails comprises a sector frame detachably fixed to one horizontal tube of said back frame at one end by a lock screw.

3. The walker of claim 1 wherein said seat frame is mounted with a seat, said seat being sliding on the seat frame rods of said seat frame.

4. The walker of claim 1 wherein the retainer plates of each of said suspension links are respectively retained in place by a respective torsional spring.

5. The walker of claim 1 wherein the sliding block of the pulley block of each of said suspension links is a rotary member.

6. The walker of claim 1 wherein said front wheel assemblies and said rear wheel assemblies are respectively equipped with a brake.

7. The walker of claim 1 wherein the horizontal top tubes of said handrails and the seat frame rods of said seat frame are respectively covered with a respective soft covering means.

* * * * *